US008446249B2

(12) United States Patent
Gerstenkorn

(10) Patent No.: US 8,446,249 B2
(45) Date of Patent: May 21, 2013

(54) METHOD OF CONTROLLING ACCESS TO AN AREA

(75) Inventor: Bernhard Gerstenkorn, Ebikon (CH)

(73) Assignee: Inventio AG, Herglswil (CH)

( * ) Notice: Subject to any disclaimer, the term of this patent is extended or adjusted under 35 U.S.C. 154(b) by 1607 days.

(21) Appl. No.: 11/460,052

(22) Filed: Jul. 26, 2006

(65) Prior Publication Data

US 2007/0025315 A1 Feb. 1, 2007

(30) Foreign Application Priority Data

Jul. 28, 2005 (EP) ..... 05106998

(51) Int. Cl.
*H04B 7/216* (2006.01)

(52) U.S. Cl.
USPC ..... 340/5.2

(58) Field of Classification Search
USPC ..... 340/5.1, 5.2, 5.21, 5.51, 5.6, 5.61–5.67, 340/5.7
See application file for complete search history.

(56) References Cited

U.S. PATENT DOCUMENTS

| | | | | |
|---|---|---|---|---|
| 7,196,610 | B2 * | 3/2007 | Straumann et al. | 340/5.61 |
| 2002/0178385 | A1 | 11/2002 | Dent et al. | |
| 2003/0043018 | A1 * | 3/2003 | Gerstenkorn | 340/5.61 |
| 2003/0081747 | A1 * | 5/2003 | Ahlstrom et al. | 379/102.06 |
| 2004/0178882 | A1 | 9/2004 | Roz et al. | |

FOREIGN PATENT DOCUMENTS

| | | | |
|---|---|---|---|
| CN | 1379343 | A | 11/2002 |
| DE | 44 22 906 | A1 | 1/1996 |
| DE | 103 61 115 | A1 | 7/2005 |
| EP | 0 965 710 | A | 12/1999 |
| EP | 1 329 409 | A | 7/2003 |
| JP | 7312776 | A | 11/1995 |
| JP | 2002161656 | A | 6/2002 |
| WO | 2001/040605 | A1 | 6/2001 |
| WO | 2005/054609 | A1 | 6/2005 |

* cited by examiner

*Primary Examiner* — Jennifer Mehmood
*Assistant Examiner* — Yong Hang Jiang
(74) *Attorney, Agent, or Firm* — Fraser Clemens Martin & Miller LLC; William J. Clemens

(57) ABSTRACT

A method of controlling access to an area accessible by persons, particularly to a space closed by a door, utilizes at least two communications units for transmitting and receiving an identification code and an access code. The identification code is transmitted at a predetermined first transmission power from a first communications unit to at least one second communications unit. The second communications unit checks the identification code and transmits an acknowledgement code at a second transmission power, which is lower than the first transmission power, from the second communications unit to the first communications unit if the check of the identification code was successful. The first communications unit transmits an access code to the second communications unit. After a successful check of the access code by the second communications unit the access is freed.

19 Claims, 1 Drawing Sheet

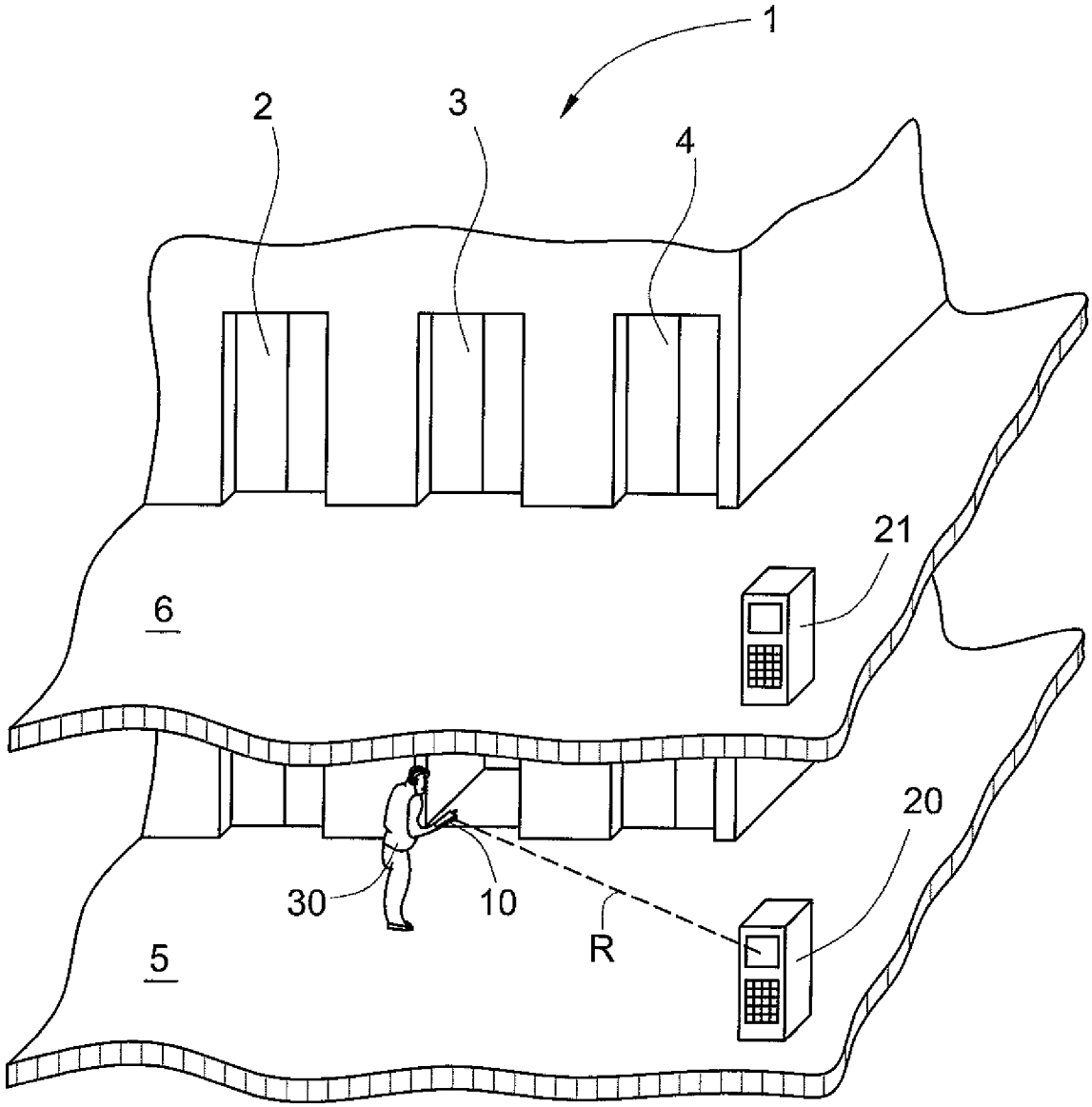
1
2
3
4
21
6
20
30
10
R
5

METHOD OF CONTROLLING ACCESS TO AN AREA

BACKGROUND OF THE INVENTION

The present invention relates to a method of controlling access to an area accessible by persons, particularly to a space closed by a door. For carrying out the method at least two communications units for transmitting and receiving an identification code, an acknowledgement code and an access code are provided. In the method the identification code is transmitted from a first communications unit to at least one second communications unit. The second communications unit checks the identification code and transmits the acknowledgement code back to the first communications unit if the check was successful. The first communications unit then transmits the access code to the second communications unit. After a successful check of the access code the access is freed.

Modern access control systems for buildings are frequently served by a chipcard on which an electronic key is filed. In order, for example, to grant access to an elevator installation a terminal with a reader for checking the chipcard and delivering a destination call is arranged on each floor in the vicinity of the elevator. Chipcards of that kind can also be integrated or inserted into a mobile communications equipment, such as, for example, a mobile telephone. However, in the case of access control systems of that kind there is the disadvantage that the mobile communications unit, from which the destination call is delivered, cannot be precisely localized in terms of position. In particular, it is frequently not possible to identify at which floor the destination call has been placed. As a consequence thereof, the destination call control of the elevator installation does not have information with regard to the floor at which the passenger to be transported is located.

A system for guiding a user in a building is known from European patent application EP 1 329 409 A2. This access control system comprises at least one transmitter/receiver unit for communication with a communications means of the user as well as at least one computer equipment for providing items of information for the user. The transmitter/receiver unit serves the purpose of identifying the communications means of the user locally within the building. The computer equipment communicates, by way of the transmitter/receiver unit, data for guidance of the user in the building to the communications means.

In this access control system it has proved disadvantageous that for localization of the communications means several transmitter/receiver units simultaneously transmit code sequences for localization of the communications means, whereby superimposition of the code sequences can occur. Beyond that, localization of the user is made difficult in that the identification code transmitted by the communications means reaches several transmitter/receiver units. Even in the case of two transmitter/receiver units, which for example are arranged on two different floors, receiving the identification code the computer unit cannot distinguish whether the communications means and thus the user is located in the vicinity of one transmitter/receiver unit on the other transmitter/receiver unit.

SUMMARY OF THE INVENTION

The present invention has an object of so developing a method of controlling access to an area accessible by persons that the second communications unit can be localized precisely in terms of position within the accessible area and thereby a user can be supplied with the correct information.

According to the present invention for fulfillment of this task in the case of a method with the features stated in the introduction it is provided that the method comprises the following steps:

a) transmitting the identification code with a predetermined first transmission power from a first communications unit to a second communications unit;

b) checking the identification code by the second communications unit;

c) transmitting the acknowledgement code at a second transmission power, which is lower than the first transmission power, from the second communications unit to the first communications unit if the check of the identification code was successful;

d) transmitting the access code from the first communications unit to the second communications unit if the check of the identification code was successful;

e) checking the access code by the second communications unit; and f) freeing the access if the check of the access code was successful.

The method according to the present invention is based on the recognition that the second communications unit after reception of an identification code transmitted from the first communications unit transmits the acknowledgement code at a second transmission power, which is lower than the first transmission power, to the first communications unit. The second transmission power is preferably such that the acknowledgement code transmitted from the first communications unit can be received only in a near field in the region of the second communications unit. The near field in this case preferably has a range of less than approximately 2 meters. Due to transmission of the acknowledgement code with a comparatively low transmission power it is avoided that another person who in fact is in the vicinity, but who due to local conditions stands in another part of the building, is incorrectly localized.

In an advantageous development of the present invention it is provided that the identification code is transmitted only within a specific range of the communications unit. This proves particularly advantageous when the transmission of the identification code takes place within a building only in specific building sections or on specific floors, so that it can be established whether a user stands in the corresponding building section. Advantageously the range is up to 30 meters.

In a development of the method according to the present invention it is proposed that the identification code is transmitted at predetermined points in time and/or within a predetermined time period. In this manner it is possible, at least with respect to the first communications unit, to achieve an energy saving by virtue of the reduced power consumption, since in time periods when there is absolutely no use of the building there is also no requirement for transmission of the identification code.

In order to enable a reliable and secure data transmission within the scope of short-distance communications technology it is of advantage if step c), step d), step e) and/or step f) is or are carried out only when the first communications unit is located within a specific range from the second communications unit. In this connection the range preferably amounts to less than approximately 5 meters, preferably less than 1 meter. Conventional interfaces, particularly infrared interfaces, can be used for the wireless, radio-based data transmission preferably to be used in this case. The Bluetooth standard is particularly suitable as transmission standard.

As a further security measure it can be provided that the access is freed only within a predetermined time period. Thus, for example, access for a first group of persons can be allowed only during the day and for a second group of persons only at night. In order to enable this, the first communications unit and/or the second communications unit and/or the access code itself can be correspondingly generated.

For provision of a time-independent security measure, in an advantageous development of the present invention the access code is cancelled after a predetermined number of uses for freeing the access. In that case the cancellation takes place either automatically or by an authorized person operating a central computer unit.

Preferably a mobile telephone is used as first communications unit. It is thus possible to avoid an obligation for the user to carry, apart from his or her mobile telephone, a further mobile communications unit. The second communications unit is preferably formed by a stationary terminal. In the case of use of the method for an elevator installation a terminal of that kind can be positioned, for example, on each floor in the vicinity of the elevator shaft. The communication between the terminal and the first communications unit then preferably takes place by way of a near-field communication. The terminal can be provided to be free-standing in the vicinity of the elevator shaft or in the region of the elevator shaft in a building wall. In the case of a free-standing arrangement the terminal can, in the case of failure of the near-field communication, be used by the user for input of the destination call.

DESCRIPTION OF THE DRAWINGS

The above, as well as other, advantages of the present invention will become readily apparent to those skilled in the art from the following detailed description of a preferred embodiment when considered in the light of the accompanying drawings in which:

FIG. 1 is a schematic view of a building having an access system according to the present invention.

DESCRIPTION OF THE PREFERRED EMBODIMENT

FIG. 1 schematically shows a system for checking access to an area, which is accessible by persons, in the form of an elevator installation 1 with three elevators 2, 3, 4. A first terminal 20 is disposed in the region of the elevator installation 1 at a first floor 5 and a second terminal 21 at a second floor 6. In order to obtain access to one of the elevators 2, 3, 4 a user 30 carries a mobile telephone 10 which forms a first communications unit. The mobile telephone 10 is equipped with a memory unit, an interface, a display and a keyboard.

The user 30 enters the building at the first floor 5, for example by way of an underground car park. The mobile telephone 10 is so equipped in terms of program that at specific points of time it automatically transmits an identification code over the duration of a predetermined time period. As soon as the user 30 comes into the vicinity of the stationary terminal 20 the terminal 20 receives the identification code transmitted by the mobile telephone 10. The check, which thereupon takes place, of the identification code by the terminal 20 is carried out in that the identification code transmitted by the mobile telephone is compared with an identification code filed in a memory unit of the terminal 20 and in the case of agreement of the two identification codes the successful check is communicated by transmission to the mobile telephone 10 of an acknowledgement code from the terminal 20 at a second transmission power which is lower than the first transmission power. In that case the transmission power is such that the acknowledgement code is transmitted only in the range of approximately two meters from the terminal 20. As a consequence thereof the acknowledgement code is received by the mobile telephone 10 only if the user is located on the first floor 5 in the vicinity of the terminal 20. In this case and if at the same time the terminal 21 at the second floor 6 transmits an acknowledgement code at the second transmission power, because it has received the identification code of the mobile telephone, this is not received by the mobile telephone 10. The Bluetooth standard is used for transmission of the acknowledgement code. Subsequently thereto there is transmitted from the mobile telephone 10 an access code, which is filed in the memory unit thereof, by way of the interface to the first terminal 20.

In this manner it can be localized where the user 30 and thus the mobile telephone 10 carried by him or her is located. After reception of the access code by the first terminal 20 the access code is compared with an original access code filed in the memory unit. In the case of agreement of the access code with the original access code a destination call control determines one or more elevators for serving the destination call. In this connection the user 30 can select the elevator preferentially recommended by the destination call control or, however, also another elevator by means of the mobile telephone and a corresponding menu guide with the help of the display keyboard. After selection of the elevator by the user 30 the destination call control communicates appropriate data for guidance of the user 30 to the selected elevator. Making the data known can take place by way of the display of the mobile telephone or by way of a display unit above the elevators. Alternatively, data can be communicated to the user 30 also by way of a speech output.

The afore-described method for access control to the elevator installation 1 can be transferred in corresponding manner also for control of access to a space closed by a door. Moreover, the afore-described method can alternatively also be carried out in such a manner that the first communications unit is formed by a stationary terminal and the second communications unit by a mobile telephone. Consequently, in this variant the terminal transmits the identification code for establishing contact with the mobile telephone.

The method according to the present invention for controlling access to the elevator installation 1 is distinguished particularly by the fact that an identification code for establishing contact is transmitted at a first transmission power and an access code for freeing the access at a second transmission power which is lower than the first transmission power. In this manner the first communications unit 10 carried by the user 30 can be accurately localized, whereby further interrogation of the access code is facilitated. The basis for that is that after a successful identification the data transmission for checking the access code can take place with a reduced transmission power, whereby a comparatively secure transmission is created.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of controlling access to an area, the method comprising:

receiving an identification code identifying a user, the identification code having been transmitted by a first communications unit at a first transmission power, the receiving being performed using a second communications unit and a third communications unit;

transmitting an acknowledgement code at a second transmission power from the second communications unit, the acknowledgement code signifying that the identification code has been successfully checked against an authorized identification code;

transmitting the acknowledgement code at the second transmission power from the third communications unit, the second transmission power being lower than the first transmission power, the transmitted acknowledgement code from the second communications unit being receivable by the first communications unit and the transmitted acknowledgement code from the third communications unit being unreceivable by the first communications unit;

receiving an access code from the first communications unit using the second communications unit;

determining the user's location relative to the second communications unit based on the receipt of the access code by the second communications unit;

granting access to the area if the access code agrees with an original access code; and providing guidance information to the user based on the user's determined location.

2. The method of claim 1 including transmitting the identification code and the acknowledgement code at specific points in time or within a predetermined time period.

3. The method of claim 1 wherein at least one of said step of transmitting an acknowledgement code, said step of receiving an access code, and said step of granting access is performed only when the first communications unit is located within the transmission range of the second communications unit.

4. The method of claim 3 wherein the transmission range is less than approximately 30 meters.

5. The method of claim 1 wherein said step of granting access is performed only within a predetermined time period.

6. The method of claim 1 including canceling the access code after a predetermined number of uses for granting the access.

7. The method of claim 1 including generating the access code using a computer unit and communicating the access code to the first communications unit.

8. The method of claim 1, wherein the first communications unit comprises a mobile telephone.

9. The method of claim 1 including using a stationary terminal as the second communications unit.

10. The method of claim 1 wherein the second communications unit and the third communications unit are located on different floors of a building.

11. The method of claim 1 wherein the area comprises an elevator installation and the step of granting access is performed by granting access to at least one elevator of the elevator installation.

12. The method of claim 11, wherein the first communications unit comprises a handheld device.

13. The method of claim 11 wherein the second and third communications units are terminals located on separate floors of a building and in a region of the elevator installation.

14. The method of claim 1 wherein the second transmission power establishes a transmission range from each of the second and third communications units and wherein the first communications unit is located within the transmission range of the second communications unit and outside the transmission range of the third communications unit.

15. An access-control method comprising:

receiving a first radio transmission including an identification code identifying a user, the first radio transmission having been transmitted by a first communications unit at a first signal level, the receiving being performed using a second communications unit and a third communications unit;

sending respective second radio transmissions at a second signal level from the second communications unit and from the third communications unit, the second radio transmissions including an acknowledgement code signifying that the identification code has been successfully checked against an authorized identification code, the second signal level being less powerful than the first signal level, the second radio transmission from the second communications unit being receivable by the first communications unit and the second radio transmission from the third communications unit being not receivable by the first communications unit;

receiving a third radio transmission ;including an access code from the first communications unit using the second communications unit;

determining the user's location relative to the second communications unit based on the receipt of the access code by the second communications unit;

granting access to an area if the access code agrees with an original access code; and providing guidance information to the user based on the user's determined location.

16. An elevator system including at least one elevator comprising:

a second communications unit for receiving an identification code identifying a user having been transmitted by a first communications unit at a first transmission power, the second communications unit being configured to transmit an acknowledgement code at a second transmission power, the acknowledgement code signifying that the identification code has been successfully checked against an authorized identification code; and a third communications unit for receiving the identification code having been transmitted by the first communications unit at the first transmission power, the third communications unit being configured to transmit the acknowledgement code at the second transmission power, the second transmission power being lower than the first transmission power, the transmitted acknowledgement code from the second communications unit being receivable by the first communications unit and the transmitted acknowledgement code from the third communications unit being unreceivable by the first communications unit, the second communications unit being further configured to receive an access code from the first communications unit and to grant access to the at least one elevator if the access code agrees with an original access code, wherein the user's location relative to the second communications unit is determined based on the receipt of the access code by the second communications unit, and guidance information is provided to the user based on the user's determined location.

17. The elevator system of claim 16 wherein the first communications unit comprises a handheld device.

18. The elevator system of claim 16 wherein the second communications unit and the third communications unit comprise respective stationary terminals and are located on different floors of a building.

19. A method of controlling access to a plurality of elevators of an elevator installation, the method comprising:

receiving an identification code identifying a user, the identification code having been transmitted by a first communications unit at a first transmission power, the receiving being performed using a second communications unit;

transmitting an acknowledgement code at a second transmission power from the second communications unit, the acknowledgement code signifying that the identification code has been successfully checked against an authorized identification code, the second transmission power being lower than the first transmission power, the transmitted acknowledgement code from the second communications unit being receivable by the first communications unit;

receiving an access code from the first communications unit using the second communications unit;

determining the user's location relative to the second communications unit based on the receipt of the access code by the second communications unit;

selecting one of the elevators;

granting access to the selected elevator if the access code agrees with an original access code; and providing guidance information to the user based on the user's determined location.

* * * * *